US006609276B1

(12) United States Patent
Lin

(10) Patent No.: US 6,609,276 B1
(45) Date of Patent: Aug. 26, 2003

(54) BUCKLE DEVICE FOR A SKATE

(76) Inventor: Chao-Ming Lin, No. 29, Lane 132, Chu-Wei-Bei Street, Kang-Shan, Kaohsiung Hsien (TW)

( * ) Notice: Subject to any disclaimer, the term of this patent is extended or adjusted under 35 U.S.C. 154(b) by 0 days.

(21) Appl. No.: 10/202,810

(22) Filed: Jul. 25, 2002

(51) Int. Cl.[7] ..... A43C 11/14

(52) U.S. Cl. ..... 24/68 SK; 24/70 SK; 24/71 SK; 36/50.1

(58) Field of Search ..... 24/68 R, 68 SK, 24/69 SK, 70 SK, 71 SK, 68 E, 68 A; 36/50.1, 50.5

(56) References Cited

U.S. PATENT DOCUMENTS 5,416,952 A * 5/1995 Dodge ..... 24/68 R
5,575,045 A * 11/1996 Chu ..... 24/68 SK
5,606,779 A * 3/1997 Lu ..... 24/68 SK

* cited by examiner

*Primary Examiner*—Robert J. Sandy
(74) *Attorney, Agent, or Firm*—Alan D. Kamrath; Rider Bennett, LLP

(57) ABSTRACT

A buckle device for a skate comprises an adjustable receptor including a frame fixed to a side of a boot upper, a pin pivotally supported by the frame, a cover plate securely mounted on the pin, and a catch member securely mounted on the pin. A strap has an end extending through a space between the frame and an end of the catch member. The strap includes ratchet teeth on an inner side thereof. When in a normal state, the end of the catch member is biased to selectively engage with the stop face of one of the ratchet teeth of the strap, such that the strap is only movable along a tightening direction. When the cover plate is pulled outward, the end of the catch member is disengaged from the ratchet teeth of the strap, allowing the strap to be moved in a loosening direction.

7 Claims, 5 Drawing Sheets

BUCKLE DEVICE FOR A SKATE

BACKGROUND OF THE INVENTION

1. Field of the Invention

The present invention relates to a buckle device for a skate that prevents undesired loosening of the buckle resulting from inadvertent impingement.

2. Description of the Related Art

Skating is a popular sport, as it is exciting and fun. A buckle device is provided on the skate in order to tightly wrap the shank and the foot of the skater while avoiding troublesome taking off of the skate. FIG. 1 of the drawings illustrates a conventional buckle device for a skate. The buckle device includes a tensioning/releasing mechanism 1, an adjustable receptor 2, and a strap 3. The tensioning/releasing mechanism 1 is fixed by a base 11 to a side of an upper 4 of a boot of a skate. The adjustable receptor 2 includes a fixed portion 21 that is fixed the other side of the upper 4. The strap 3 includes a first end pivoted by a member 32 to the tensioning/releasing mechanism 1 and a second end extending through the adjustable receptor 2. The strap 3 further includes a plurality of ratchet teeth 31 on an outer side thereof, each ratchet tooth 31 having a stop face 311 and a slide face 312. A lever 22 is pivotally mounted on the fixed portion 21 of the adjustable receptor 2 and includes a catch (not shown). When in a normal state (i.e., the lever 22 is not pushed), the catch is engaged with the stop face 311 of an associated tooth 31 such that the strap 3 can only be moved along a tightening direction relative to the adjustable receptor 2. When the lever 22 is pushed, the catch is disengaged from the stop face 311 of the associated tooth 31, allowing movement of the strap 3 in a loosening direction. The strap 3 may be completely disengaged from the adjustable receptor 2 when taking off the skate. A release arm 12 is pivoted to the base 11 of the tensioning/releasing mechanism 1 and movable between a retaining position shown in FIG. 1 for retaining the strap 3 in its tightening state and a release state (not shown) for loosening the buckle device.

However, the lever 22 could be inadvertently impinged and thus causes movement of the strap 3 in the loosening direction. The skater might be injured. Further, the outer side of the strap 3 is full with ratchet teeth 31 and thus could not provide a space for decorative patterns and/or trademarks.

SUMMARY OF THE INVENTION

An object of the present invention is to provide a buckle device for a skate that prevents undesired loosening of the buckle resulting from inadvertent impingement.

Another object of the present invention is to provide a buckle device for a skate that includes a strap having an outer side on which decorative patterns and/or a trademark can be printed.

A buckle device for a skate in accordance with the present invention comprises an adjustable receptor comprising a frame adapted to be fixed to a side of an upper of a boot of a skate, a pin pivotally supported by the frame, a cover plate securely mounted on the pin to pivot therewith, and a catch member securely mounted on the pin to pivot therewith, the catch member including an end. A strap has an end extending through a space between the frame and the end of the catch member. The strap includes a plurality of ratchet teeth on an inner side thereof, each ratchet tooth including a stop face and a slide face.

When in a normal state, the end of the catch member is biased to selectively engage with the stop face of one of the ratchet teeth of the strap, such that the strap is only movable along a tightening direction. When the cover plate is pulled outward, the pin and the catch member pivot such that the end of the catch member is disengaged from the ratchet teeth of the strap, allowing the strap to be moved in either one of the tightening direction and a loosening direction opposite to the tightening direction.

Other objects, advantages, and novel features of the invention will become more apparent from the following detailed description when taken in conjunction with the accompanying drawings.

DETAILED DESCRIPTION OF THE EMBODIMENT

Figure 1:
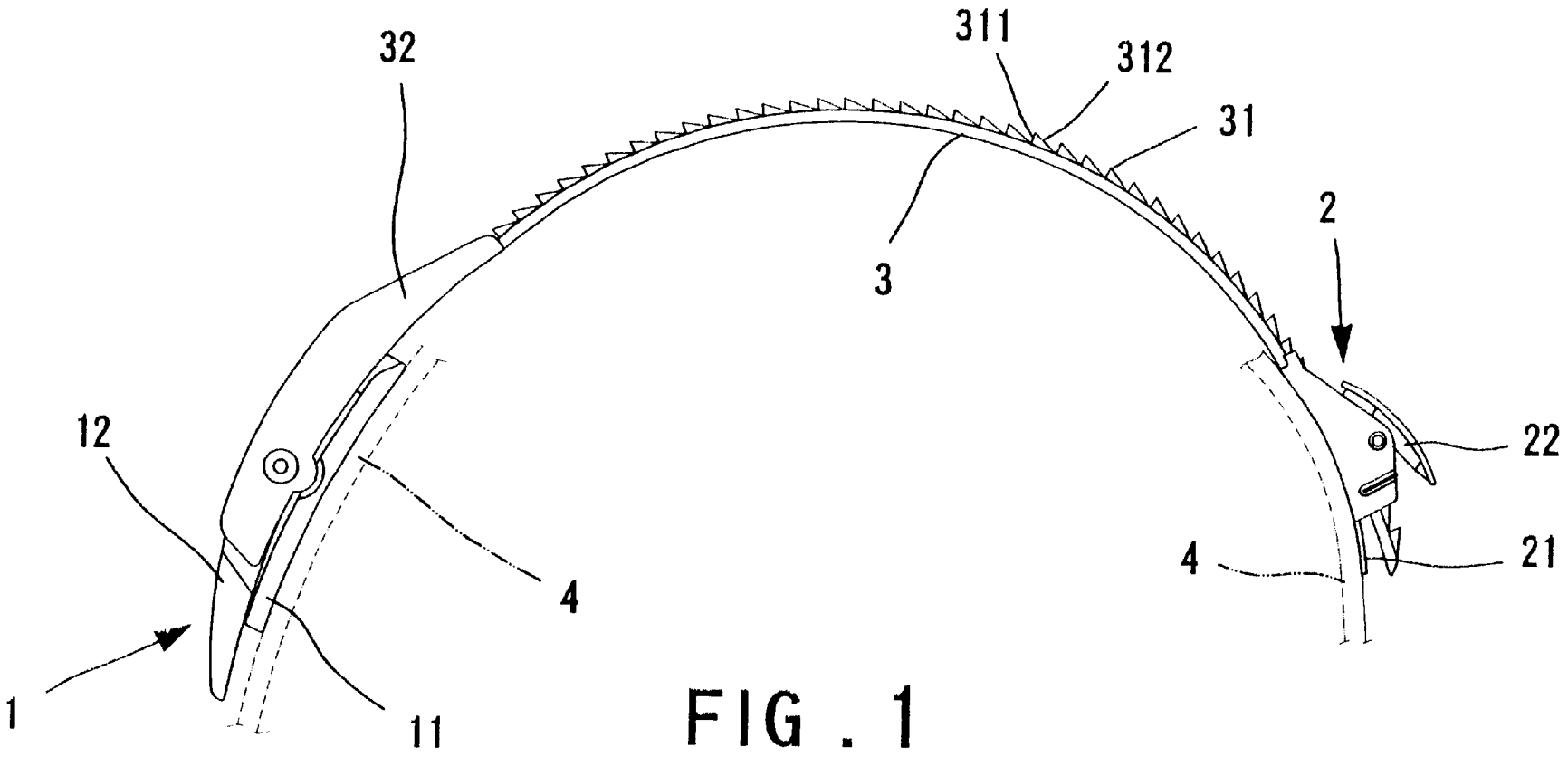
FIG. 1 PRIOR ART
FIG. 1 is a schematic side view of a conventional buckle device for a skate.
Figure 2:
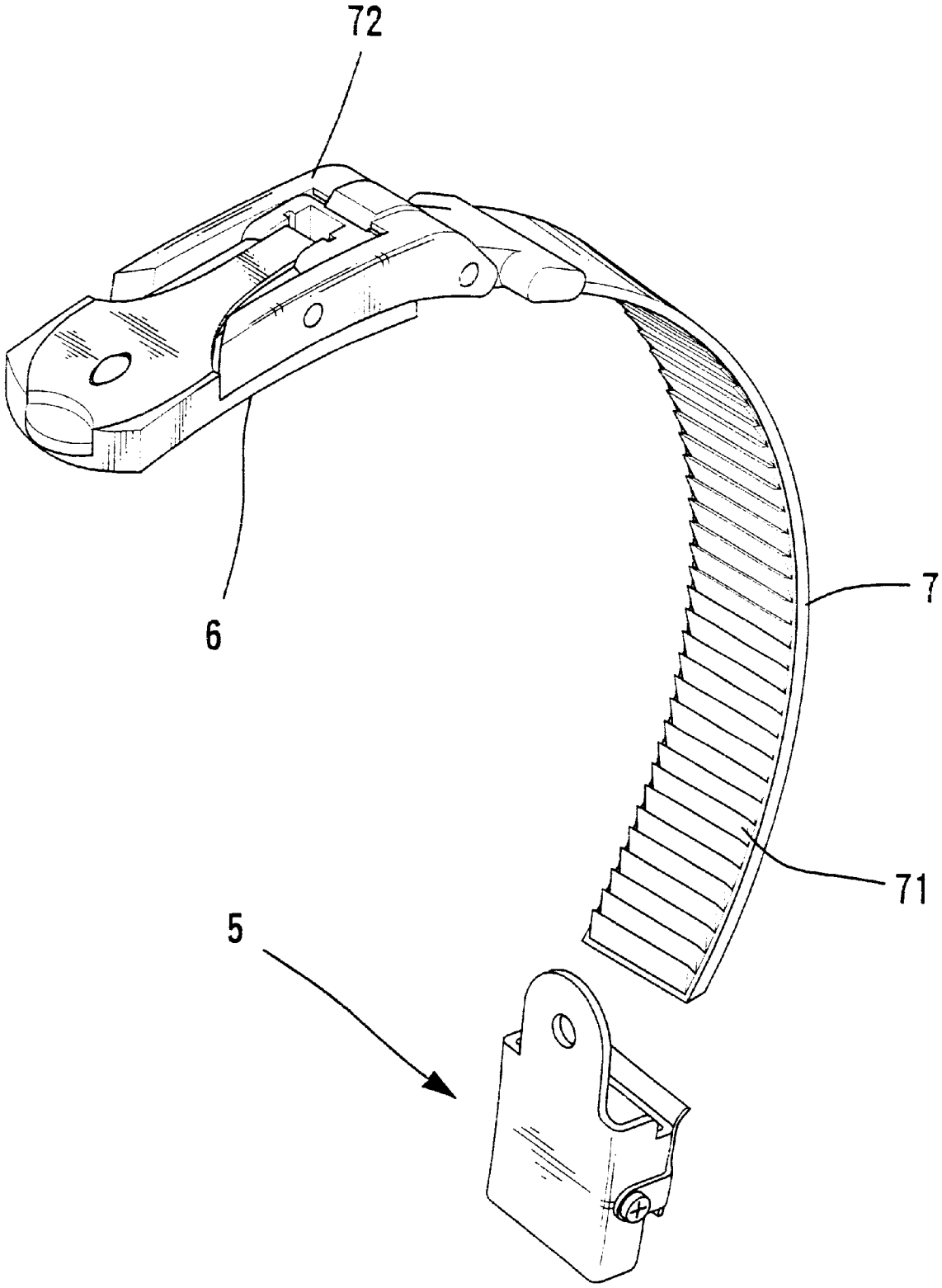
FIG. 2 is a perspective view of a buckle device for a skate in accordance with the present invention.

Referring to FIG. 2, a buckle device for a skate in accordance with the present invention generally comprises an adjustable receptor 5 and a strap 7. Similar to the conventional design, a tensioning/releasing mechanism 6 has an end attached to a side of an upper 4 of a boot of a skate. An end of the strap 7 is attached to a pivotal member 72 of the tensioning/releasing mechanism 6, which is not within the scope of the invention and therefore not described in detail.

Figure 4:
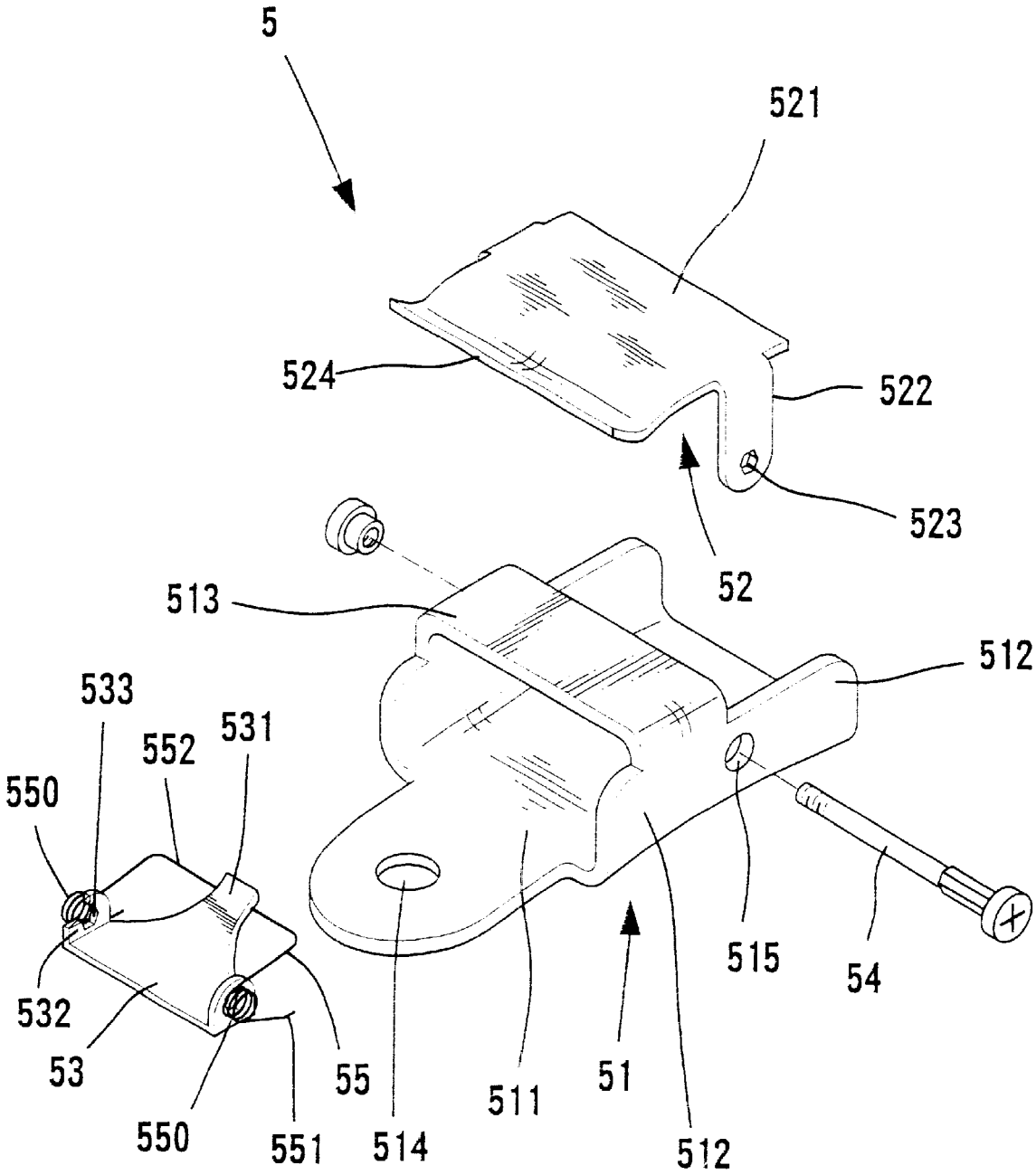
FIG. 4 is an exploded perspective view of an adjustable receptor of the buckle device for a skate in accordance with the present invention.

Referring to FIG. 4, the adjustable receptor 5 includes a frame 51 that is fixed the other side of the upper 4 (see fixing hole 514 in FIG. 4). The other end of the strap 7 extends through the adjustable receptor 2. The strap 7 includes a plurality of ratchet teeth 71 on an inner side thereof. Namely, the ratchet teeth 71 of the strap 7 are formed on the inner side of the strap 7 that faces the upper 4 of the boot. Each ratchet tooth 71 has a stop face 711 and a slide face 712. Still referring to FIG. 4, the frame 51 includes a bottom wall 511, two sidewalls 512, and a top plate 513 extending between the sidewalls 512. A pin 54 is pivotally supported by the frame 51, and a cover plate 52 is pivotally mounted on the frame 51 of the adjustable receptor 5 and includes a pull end 524. In this embodiment, the pin 54 is pivotally extended through aligned holes 515 in the sidewalls 512 of the frame 51 and through aligned holes 523 in two arms 522 respectively extending from two sides of the cover plate 52. Each hole 523 is non-circular (hexagonal in this embodiment) for secure engagement with the pin 54, allowing joint movement of the pin 54 and the cover plate 51. A catch member 53 is secured to the pin 54 to turn therewith. In this embodiment, the catch member 53 includes two spaced ears 532 having aligned hexagonal holes 533 through which the pin 54 extends. The catch member 53 includes an end 531 engaging with the stop face 711 of an associated tooth 71 of the strap 7. An elastic elements 55 is provided for biasing the end 531 of the catch member 53 to engage with the stop face 711 of an associated tooth 71. in this embodiment, the elastic element 55 includes two spaced coil portions 550 each having a first end 551 and a second end connected by a U-shaped wire 552. Nevertheless, a simple torsion spring can be used.

Figure 3:
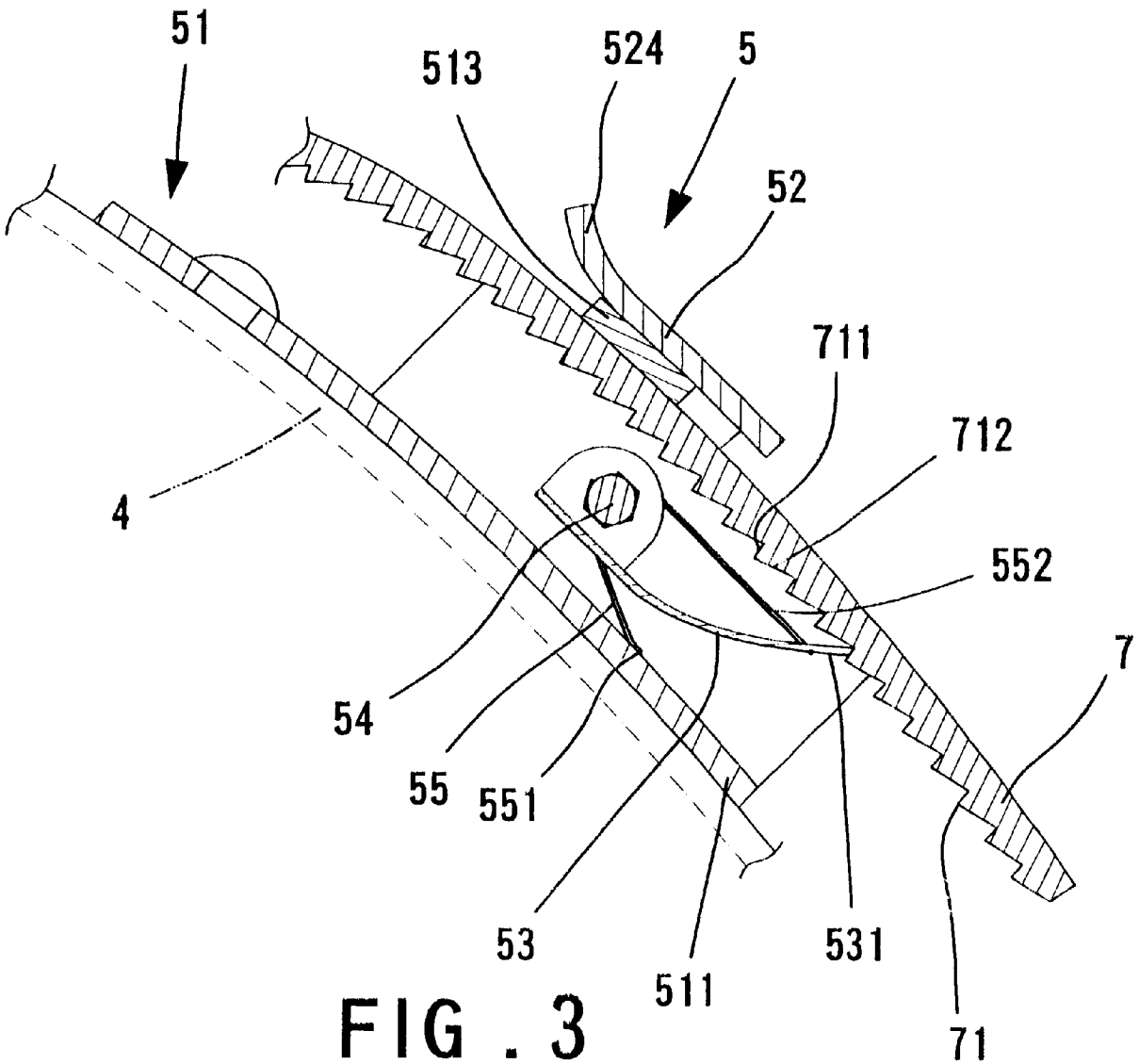
FIG. 3 is a sectional view of the buckle device in accordance with the present invention, wherein a cover plate of the buckle device is not pulled.

The other end of the strap 7 is extended through a space between the frame 51 of the adjustable receptor 5 and the end 531 of the catch member 53. When in a normal state (i.e., the cover plate 52 is not pulled), the first end 551 of each coil portion 550 is attached to the bottom wall 511 of the frame 51, and the end 531 of the catch member 53 is engaged with the stop face 711 of an associated tooth 71 such that the strap 7 can only be moved along a tightening direction relative to the frame 51 of the adjustable receptor 5, as shown in FIG. 3.

Figure 5:
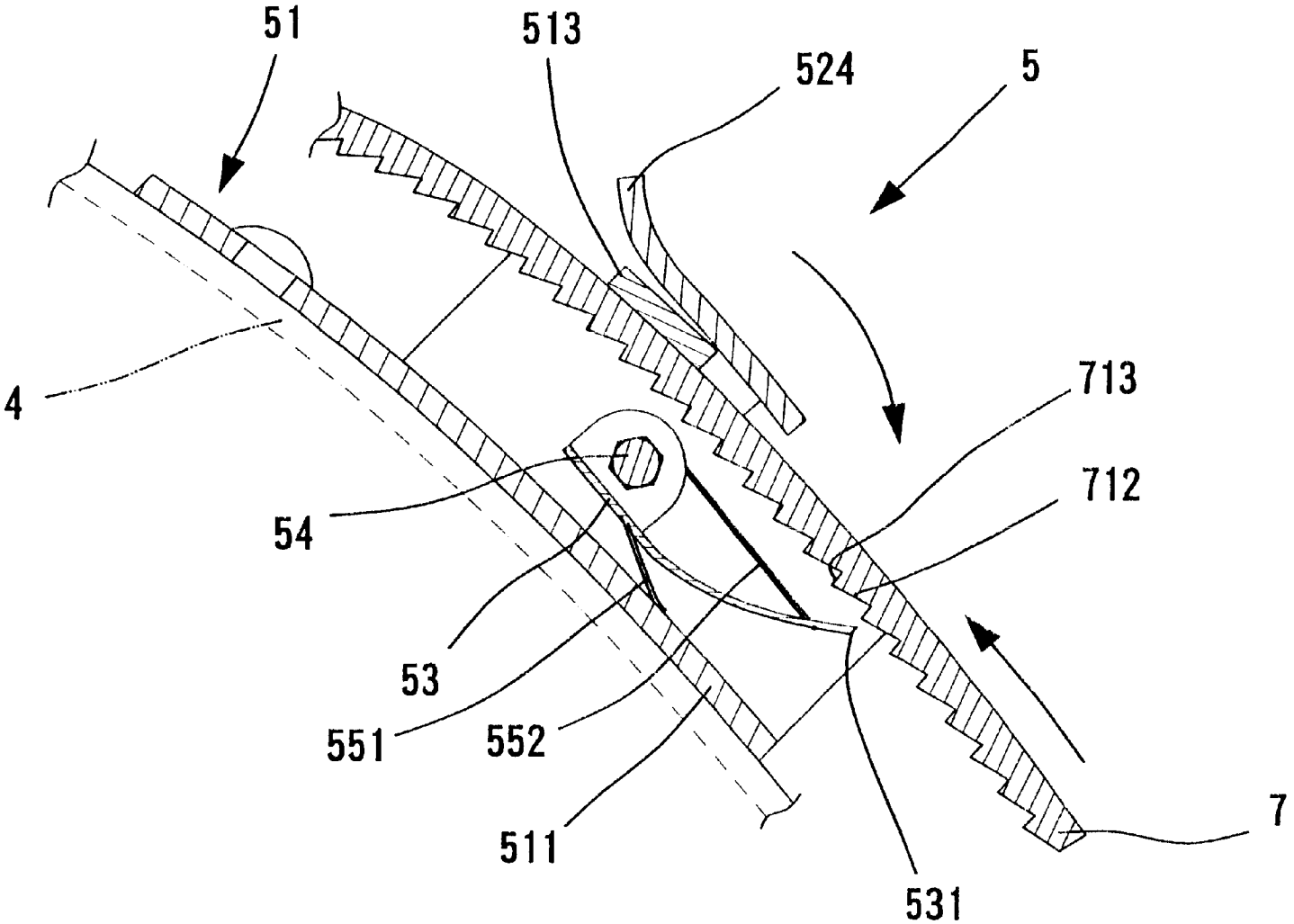
FIG. 5 is a sectional view similar to FIG. 3, wherein cover plate of the buckle device is pulled.

Referring to FIG. 5, when the pull end 524 of the cover plate 52 is pulled outward, the pin 54 and the catch member 53 pivot together with the cover plate 52. Thus, the end 531 of the catch member 53 is disengaged from the stop face 711 of the associated tooth 71, and a larger gap is defined between the end 531 of the catch member 53 and the top plate 513 of the frame 51, allowing movement of the strap 7 in a loosening direction (see the arrow in FIG. 5). The strap 7 may be completely disengaged from the adjustable receptor 5 when taking off the skate. Of course, the strap 7 can be moved along the tightening direction, if desired. When the cover plate 52 is released, the end 531 of the catch member 53 is returned to its position shown in FIG. 3 under the action of the elastic element 55.

Thus, inadvertent impingement to the cover plate 52 cannot cause movement of the strap 7 in the loosening direction, as movement of the strap 7 in the loosening direction can only be achieved when the cover plate 52 is pulled. The outer side of the strap 7 is blank (without ratchet teeth) and thus provides a space for forming or printing decorative pattern(s) and/or trademark(s).

Although the invention has been explained in relation to its preferred embodiment, it is to be understood that many other possible modifications and variations can be made without departing from the scope of the invention as hereinafter claimed.

What is claimed is:

1. A buckle device for a skate, the buckle comprising:

an adjustable receptor comprising a frame adapted to be fixed to a side of an upper of a boot of a skate, a pin pivotally supported by the frame, a cover plate securely mounted on the pin to pivot therewith, and a catch member securely mounted on the pin to pivot therewith, the catch member including an end; and a strap having an end extending through a space between the frame and the end of the catch member, the strap including a plurality of ratchet teeth on an inner side thereof, each said ratchet tooth including a stop face and a slide face;

wherein when in a normal state, the end of the catch member is biased to selectively engage with the stop face of one of the ratchet teeth of the strap, such that the strap is only movable along a tightening direction; and wherein when the cover plate is pulled outward, the pin and the catch member pivot such that the end of the catch member is disengaged from the ratchet teeth of the strap, allowing the strap to be moved in either one of the tightening direction and a loosening direction opposite to the tightening direction.

2. The buckle device for a skate as claimed in claim 1, wherein the frame includes a bottom wall, two sidewalls, and a top wall, the pin being pivotally extended through the sidewalls.

3. The buckle device for a skate as claimed in claim 1, wherein the cover plate includes two arms extending from two sides thereof, the pin being securely extended through the arms.

4. The buckle device for a skate as claimed in claim 1, wherein the catch member includes two spaced lugs through which the pin is securely extended.

5. The buckle device for a skate as claimed in claim 1, wherein the cover plate includes a pull end allowing easy grasp of a user.

6. The buckle device for a skate as claimed in claim 1, further comprising an elastic element for biasing the end of the catch member to engage with the stop face of one of the ratchet teeth of the strap, the elastic element includes a first end abutting against the frame and a second end abutting against the catch member.

7. The buckle device for a skate as claimed in claim 2, further comprising an elastic element for biasing the end of the catch member to engage with the stop face of one of the ratchet teeth of the strap, the elastic element includes a first end abutting against the bottom wall of the frame and a second end abutting against the end of the catch member.

* * * * *